8-108.1 SR
F6966 XR 4,141,685

United States Patent [19]
Balland

[11] 4,141,685
[45] Feb. 27, 1979

[54] METHOD OF BLEACHING TEXTILE FIBERS AND ACTIVATED BATH FOR THE COLD BLEACHING OF SUCH FIBERS

[75] Inventor: Jean Balland, Chateaurenault, France

[73] Assignee: Manufacture de Produits Chimiques Protex Societe Anonyme, Paris, France

[21] Appl. No.: 818,677

[22] Filed: Jul. 25, 1977

[30] Foreign Application Priority Data

Jul. 26, 1976 [FR] France ..... 76 23289

[51] Int. Cl.[2] ..... D06L 3/00; D06L 3/10
[52] U.S. Cl. ..... 8/110; 8/108 A; 8/108 R; 252/95; 252/105; 260/513 R
[58] Field of Search ..... 8/110, 108.5; 252/95, 252/105; 260/513 R, 513 B

[56] References Cited

U.S. PATENT DOCUMENTS

| | | | |
|---|---|---|---|
| 1,958,483 | 5/1934 | Loughlin | 8/110 |
| 2,107,197 | 2/1938 | Batignof | 260/513 R |
| 2,339,594 | 1/1944 | Williams | 8/110 |
| 2,430,674 | 11/1947 | Hampel | 8/108.5 |
| 2,544,562 | 3/1951 | Michael | 260/513 B |
| 2,944,872 | 7/1960 | Vermijs | 8/108.5 |
| 3,097,049 | 7/1963 | Neybeck et al. | 8/108.5 |
| 3,321,498 | 5/1967 | Kortland et al. | 260/513 B |
| 3,645,665 | 2/1972 | Etters | 260/513 B |
| 3,677,821 | 7/1972 | Tanaka | 8/110 |

*Primary Examiner*—William E. Schulz
*Attorney, Agent, or Firm*—Karl F. Ross

[57] ABSTRACT

A sodium chlorite bath for the bleaching of textile fibers, e.g. cotton, is activated by one or more bisulfite derivatives of an organic-reducing compound having one or more aldehyde or ketone functional groups and which are capable of forming bisulfitic combination addition compounds with an alkali bisulfite. Such activators have been found to be effective in bringing about the progressive decomposition of the sodium chlorite of the bath and hence controlled bleaching at relatively low temperatures of the sodium chlorite bath.

13 Claims, No Drawings

METHOD OF BLEACHING TEXTILE FIBERS AND ACTIVATED BATH FOR THE COLD BLEACHING OF SUCH FIBERS

FIELD OF THE INVENTION

The present invention relates to a bleaching process using an aqueous sodium chlorite bath for the bleaching of textile fibers and fabrics and to improvements in the activation of such bleaching baths. More particularly, the invention relates to new activation substances for sodium chlorite-based bleaching baths for textile materials and their application in the bleaching process by impregnation/cold storage.

BACKGROUND OF THE INVENTION

It is know that sodium chlorite aqueous bleaching baths can be used effectively for the bleaching of textile fibers and other organic materials. The bleaching action resides in the oxidizing effect of the various chlorine compounds which are generated and, as need arises, from the nascent oxygen which is formed by decomposition of the chlorite in acid milieu.

This composition can be effected in a cold state, i.e. at room temperature or temperatures therebelow, by direct acidification of this solution or by the introduction into the latter of reducing compounds such as formaldehyde. The decomposition is brought about practically instantaneously upon the introduction of the activator (acid or aldehyde) into the chlorite solution. The baths yellow rapidly and give rise to a rapid release of the chlorine derivatives. The oxidizing action of the chlorite baths activated cold under these conditions is excessive and generally too rapid for commercial use in the bleaching of textile fibers which requires the ability to control the process over a relatively prolonged period of time to obtain uniform and reproducible results.

It is thus esential that a bleaching bath possess a certain stability beyond the moment of preparation, especially if the process is to be carried out in a normal operating line of a textile plant. Furthermore, for health and safety reasons, it is not possible to permit chlorine dioxide, of high toxicity, to be released freely into the atmosphere as frequently occurs with conventional activators for a cold bleaching bath.

Most of the current processes for the bleaching of textile materials using sodium chlorite baths thus operate at elevated temperatures in the presence of activators for the decomposition of the chlorite. The conjoint action of the elevated temperature, usually between 70° and 90° C., and the activation agents permit the decomposition of the chlorite to be progressive and controlled, guaranteeing uniform bleaching.

However, this decomposition is practically always accompanied by release of chlorine compounds, more specifically chlorine dioxide, of high toxicity. Apart from their toxicity and the toxicity of other released chlorine compounds, the chlorine compounds have been found to manifest a corrosive activity upon the materials generally used for the construction of the textile machines. Thus it is necessary to provide materials, vats, vapor-collection chambers and the like, specifically adapted to resist corrosive attack.

OBJECTS OF THE INVENTION

It is the principal object of the present invention to provide a process for the bleaching of textile materials whereby the aforedescribed disadvantages can be obviated.

Another object of the invention is to provide a process for the bleaching of textile materials which can be carried out at relatively low temperatures and which permits storage-type treatment at low temperatures of the bleaching bath without detrimental and rapid release of chlorine compounds which are toxic and corrosive.

Yet another object of the invention is to provide a bath for the bleaching of textile materials which can be used in a cold state and which has high stability.

Yet another object of the invention is to provide an activation agent for a sodium chlorite bleaching bath which permits the bleaching process to be gradual and controlled.

It is yet another object of the invention to provide a relatively controllable and gradual process for the uniform and reproducible bleaching of textile materials without the drawbacks enumerated above.

DESCRIPTION OF THE INVENTION

These objects and others which will become apparent hereinafter are attained, in accordance with the present invention, in a process for the bleaching of textile materials which involves the low-temperature contact of the textile materials with an aqueous bleaching bath containing sodium chlorite as the bleaching agent and to which a new activation product is added in order to control the rate of decomposition of the chlorite and carry out the bleaching action progressively and gradually.

The invention also resides in the provision of an activation product for a sodium chlorite bleaching bath which permits better control of the bleaching operation.

More specifically, an activation agent for a sodium chlorite bleaching bath comprises a bisulfitic derivative of an organic reducing compound which has, in its molecule, one or more aldehyde or ketone functional groups, and which is capable of forming bisulfitic combinations (addition compounds) with alkali bisulfite.

By the addition of these bisulfitic combinations to the bleaching bath, it is possible to obtain at relatively low temperatures a progressive and controlled decomposition of the chlorite in a sodium chlorite bleaching bath over an extended period of time.

The activation compounds which can be used in accordance with a specific feature of the invention, for forming a bisulfitic combination with an alkali bisulfite, e.g. sodium bisulfite, can be one of the following classes:

Aliphatic monoaldehydes, having an alkyl or alkenyl group of 1 - 10 carbon atoms, especially formaldehyde, acetaldehyde, and glycolicaldehyde.

Aliphatic dialdehydes, having alkyl and alkenyl chains of 2 - 10 carbon atoms, preferably glyoxal.

Aliphatic monoketones, having alkyl and alkenyl chains of 1 - 10 carbon atoms each connected to the ketocarbon, especially acetone.

Aliphatic diketones, having 1 - 10 carbon atoms in each of the alkyl or alkenyl groups, preferably acetylketone.

Aromatic aldehydes in which the aromatic group is preferably phenyl, preferably benzaldehyde and cinnamaldehyde.

The bisulfitic derivatives are preferably obtained by a combination of an alkali bisulfite and an aliphatic monoaldehyde, most preferably formaldehyde or acetaldehyde.

The alkali bisulfite which may be used in accordance with the present invention can be lithium bisulfite, sodium bisulfite or potassium bisulfite, although sodium bisulfite is preferred.

The quantity of the bisulfitic derivative which is added to the sodium chlorite bleaching bath can range between 1 and 30 g/l and preferably is between 3 and 10 g/l.

The bisulfitic combinations of the organic reducing compounds mentioned above are advantageously present together with a certain quantity of neutral alkali sulfite, preferably between 0 and 20 g/l, with best results between 2.5 and 10 g/l of this substance. The alkali sulfite may be lithium sulfite, sodium sulfite or potassium sulfite, although best results are obtained with sodium sulfite.

The relative quantity of the sulfite added to the chlorite bleaching bath simultaneously with the bisulfitic combinations of the reducing compounds, permits control with time of the rate of decomposition of the chlorite.

The table given below summarizes the effect on the stability of a solution of 20 g/l of sodium chlorite at 80%, of the addition of variable quantities of neutral sodium sulfite and a constant quantity ( 5 g/l) of the bisulfitic combination obtained by the reaction of formaldehyde with sodium bisulfite and added to the chlorite bath.

TABLE 1

| COMPOSITION | STABILITY |
|---|---|
| 5 g/l of bisulfitic compound | 15 minutes |
| 5 g/l of bisulfitic compound + 2.5 g/l of sodium sulfite | 40 - 45 minutes |
| 5 g/l bisulfitic compound + 5 g/l of sodium sulfite | 80 - 90 minutes |

Once the decomposition begins, the triggering of the reaction processes results, on the one hand, in a progressive acidification of the bath, a stabilization of the pH at about 4.5 and development of a yellowing of the bath. It gives rise, on the other hand, to a significant whitening of the textile fibers which, in the case of cotton, completely eliminates the fiber hull after a treatment of several hours in a cold state.

The technique of the present invention can be applied readily in conventional fiber and fabric processing technology for the bleaching of fibrous materials. The present process is particularly effective to permit sodium chlorite baths to be generally applied for bleaching techniques known in the art as impregnation/cold storage. The new process comprises, in the case of woven and knitted (tricot) fabrics, the following steps:

(a) impregnation of the fabric in a sodium chlorite bath to which a compound of the new activation type disclosed herein has been added, preferably at a pH below 5.5;

(b) expressing the excess liquid from the material by passing the same between the rolls of a squeezing machine so that the fibers retain about 100% of their dry weight in liquid;

(c) coiling the impregnated material upon a drum of wood or a drum of metal coated by a protective layer;

(d) enclosing the impregnated material after coiling in a plastic envelope or covering;

(e) depositing the coil, generally having been placed in slow rotation, for a predetermined duration which is a function of the material and the operating conditions but generally between 6 and 16 hours, at a temperature of the order of 20° C., generally between 5° C. and 60° C.; and (f) thereafter opening the plastic envelope, washing the material on the coil with hot and then cold water, followed or accompanied by any conventional dechlorination treatment.

Textile materials is nonwoven matted form or as threads can be treated in a similar manner, i.e. with impregnation, removal of excess liquid by draining or suction, followed by storage in a plastic envelope, in this place usually bags, at ambient temperature for the time necessary for the desired degree of the whitening action.

In the case of impregnation/cold storage, the drawbacks heretofore encountered with the rapid decomposition of chlorite are eliminated and the chlorite decomposition is reduced to a minimum. The protection of the textile material in a plastic envelope, moreover, elminates any possibility of pollution of the atmosphere of the factory by the release of chlorine oxides and it does not give rise to any corrosion since for the duration of chlorite decomposition, the liquid phase is not in contact with a metallic surface. When wood is used as the reel or drum or a metal drum is employed which has a protective coating, all attack on parts of the textile-treatment machine are obviated.

The bleaching bath can be prepared in advance within the limits of the stability of the bath against cold decomposition of the chlorite as set forth above. It is most advantageous, however, especially in view of the fluctuating processing loads of normal textile factories, that the bisulfitic combination and the sodium sulfite not be added to the chlorite bath until just prior to or upon use. These components can also be added, in accordance with a feature of the invention, during impregnation.

The possibility of carrying out the bleaching treatment with sodium chlorite in a cold state is of special importance to the present invention. It has been found, in this connection, that an increase in the storage temperature sharply increases the reaction processes which result in decomposition of the sodium chlorite and thus the bleaching process. It is, therefore, possible to reduce the storage duration, i.e. the length of the treatment of the material in the envelope. However, it becomes necessary when attempts are made to raise the temperature, to isolate the material impregnated and to be heated from the treatment chambers to prevent corrosion or to construct these chambers from noncorrodable materials.

SPECIFIC EXAMPLES

EXAMPLE 1

A woven fabric of raw cotton, sized with starch, of a weight of 220 g/m$^2$ is impregnated in an aqueous bath containing:

20 g/l of sodium chlorite (commercial product containing 80% $NaClO_2$);

6 g/l of a compound formed by combining formaldehyde and sodium bisulfite and having the following formula:

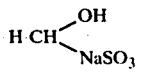

(corresponding to the reaction product of equimolar quantities of the formaldehyde and sodium bisulfite);

3 g/l of neutral sodium sulfite;

0.5 g/l of sodium carbonate;

2 g/l of the sodium salt of dioctylsulfosuccinic acid, the latter constituting a surface active agent to facilitate impregnation.

The bath remains stable for 3.5 hours at ambient temperature.

Impregnation is effected using a pad-mangle by squeezing the material with the solution so that, after expression of excess liquid, the impregnated material contains 100% of its original weight as retained water.

The fabric is then wound upon a metallic drum previously covered by a protective layer, preferably polyethylene, the coil being then introduced into a plastic-foil bag and caused to rotate slowly for 15 hours at ambient temperature (about 20° C.).

After washing and drying, the fabric is completely freed from the natural hull of the cotton fiber and has the following characteristic, compared to the grey fabric:

TABLE 2

Degree of whiteness (measured by the Elrepho apparatus):

grey — 54% bleached — 75%

Proportion of size:

grey — 9% bleached — 4%

Relative hydrophilic character (determined by measuring capillary climb):

grey — 0 cm bleached — 11 cm

EXAMPLE 2

The treatment conditions are identical to those of Example 1 but the quantity of neutral sodium sulfite is raised to 6 g/l. The bath remained stable for 5 hours at ambient temperature.

The bleached fabric has a degree of whiteness of 72, i.e. only slightly less than that bleached under the conditions of Example 1.

EXAMPLE 3

The treatment conditions were identical to those of Example 1 but the cotton fabric was previously subjected to an enzymatic desizing treatment whereby the coating of the cotton fibers was broken down in part by enzymatic decomposition. After bleaching, the fabric had the following characteristics, compared to that of a fabric simply desized by the enzymatic technique:

Degree of whiteness:

desized — 56 bleached — 82

Hydrophilic character:

desized — 0 cm bleached — 17 cm

A prior desizing action has been found to increase the bleaching efficiency under cold conditions and gives a much higher level of whiteness.

Parallel test have shown that quantities of the sodium chlorite of the order of 7 to 10 g/l in the bath give the best results with respect to whiteness for fabrics which are previously desized or have not been subjected to a desizing treatment before bleaching.

EXAMPLE 4

Cotton poplin of 140 g/m$^2$, previously subjected to a desizing and boiling treatment is impregnated with an aqueous bath containing:

10 g/l of sodium chlorite (80% $NaClO_2$);

4 g/l bisulfite compound of Example 1;

2 g/l neutral sodium sulfite;

0.5 g/l sodium carbonate.

This bath remained stable for 4 hours at ambient temperature.

After impregnation at ambient temperature, the liquid is expressed from the textile material until the textile material contains only an amount of the liquid equal to its dry weight. The material is coiled as described and enclosed in a plastic bag, the coil being subjected to slow rotation for a periof of 8 hours at ambient temperature.

After washing and drying, the fabric is completely free from the natural shell on the cotton fibers and has the following characteristics, compared to a fabric not treated in accordance with the present invention but subjected to desizing and boiling:

Degree of whiteness:

before bleaching — 59 after bleaching — 84

Hydrophilic character:

before bleaching — 14 cm after bleaching — 23 cm

When the same test was carried out on a fabric comprising mixtures of cotton and polyamide, cotton and polyester and cotton, polyamide and polester, similar excellent results were obtained in the cold state.

EXAMPLE 5

The treatment conditions were the same as those of Example 4 but the bisulfitic combination employed was that which was formed by the reaction of acetaldehyde with sodium bisulfite and had the following formula:

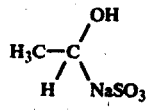

The bath remained stable for 3.5 hours at ambient temperature. After treatment, the results from the point of view to the degree of whiteness and hydrophilic character are practically identical to those of Example 4.

EXAMPLE 6

Raw loose fibers of cotton are impregnated at 18° C. in an aqueous bath containing:

15 g/l of sodium chlorite (80% $NaClO_2$);

7 g/l of the bisulfite combination of Example 1;

3 g/l of neutral sodium sulfite;

1 g/l of sodium carbonate; and 2 g/l of the surface active agent of Example 1.

After impregnation, the material is drained so that it retains 90% of its dry weight of the impregnating solution.

The impregnated material is stored for a period of 8 hours in plastic bags at a temperature of 25° C. After treatment, the cotton mat is found to be completely free of the natural shell which is originally present on the cotton fibers and has a high degree of whiteness.

EXAMPLE 7

A raw cotton twill having a weight of 180 g/m$^2$ is impregnated with an aqueous bath containing, without prior desizing 15 g/l of sodium chlorite (70% $NaClO_2$);
7 g/l of the bisulfitic compound of Example 1;
7 g/l of sodium sulfite;
1 g/l of sodium carbonate; and
2 g/l of the surface active agent of Example 1.

The bath is found to be stable for a period of 5 hours at ambient temperature.

After impregnation and expression of liquid so that the material contains an amount of the impregnating solution equal to its original dry weight, the coil is placed in a plastic envelope after coiling on a plastic coating of a drum and enclosed in a noncorrodable receptacle for a period of 4 hours at a temperature of 50° C.

After treatment, the fabric is found to be completely free from the shell which originally covered the cotton fibers and has the following characteristics compared to the raw fabric:

Degree of whiteness:
raw 56
bleached 82
Hydrophilic character:
raw 0 cm
bleached 17 cm Exemples 1 and 7 were each carried out similarly with, however, the bisulfitic compound replaced by each of the following:

reaction product of equimolar quantities of acetaldehyde and sodium bisulfite;
equimolar quantities of glycolic aldehyde and sodium bisulfite;
equimolar quantities of glyoxal and sodium bisulfite;
2 moles of sodium bisulfite with one mole of glyoxal;
equimolar quantities of sodium bisulfite and acetone;
equimolar quantities of acetylketone and sodium bisulfite;
equimolar quantities of benzaldehyde and sodium bisulfite;
and equimolar quantities of cinnamicaldehyde and sodium bisulfite.

I claim:

1. A composition for the activation of a sodium chlorite textile bleaching bath which consists of a bisulfitic derivative of an organic reducing compound and constituted of the reaction product of an alkali bisulfite selected from the group which consists of lithium bisulfite, sodium bisulfite and potassium bisulfite, with an aliphatic monoaldehyde having an alkyl or alkenyl group of 1 to 10 carbon atems, an aliphatic dialdehyde having an alkyl or alkenyl chain of 2 to 10 carbon atoms, an aliphatic monoketone having alkyl or alkenyl chains of 1 to 10 carbon atoms each connected to the ketocarbon, an aliphatic diketone having 1 to 10 carbon atoms in each alkyl or alkenyl group, or an aromatic aldehyde in which the aromatic group is phenyl.

2. The composition defined in claim 1 wherein said organic compound is selected from the group which consists of formaldehyde, acetaldehyde, glycolicaldehyde, glyoxal, acetone, acetylketone, benzaldehyde and cinnamaldehyde.

3. An aqueous sodium chlorite bleaching bath for the bleaching of textiles which contains 1 to 30 g/l of a bisulfitic derivative of an organic reducing compound and constituted of the reaction product of an alkali bisulfite selected from the group which consists of lithium bisulfite, sodium bisulfite and potassium bisulfite, with an aliphatic monoaldehyde having an alkyl or alkenyl group of 1 to 10 carbon atoms, an aliphatic dialdehyde having an alkyl or alkenyl chain of 2 to 10 carbon atoms, an aliphatic monoketone having alkyl or alkenyl chains of 1 to 10 carbon atoms each connected to the ketocarbon, an aliphatic diketone having 1 to 10 carbon atoms in each alkyl or alkenyl group, or an aromatic aldehyde in which the aromatic group is phenyl.

4. The bath defined in claim 3 wherein said bisulfitic derivative is present in an amount between 3 and 10 g/l.

5. The bath defined in claim 4 which contains sodium sulfite in addition to said derivative in an amount up to 20 g/l.

6. The bath defined in claim 5 wherein said sodium sulfite is present in an amount between 2.5 and 10 g/l.

7. The bath defined in claim 3 wherein said organic compound is selected from the group which consists of formaldehyde, acetaldehyde, glycolicaldehyde, glyoxal, acetone, acetylketone, benzaldehyde and cinnamaldehyde.

8. A method of bleaching textile fibers comprising the steps of:

introducing into an aqueous sodium chlorite bleaching bath an activating bisulfitic derivative of an organic reducing compound and constituted of the reaction product of an alkali bisulfite selected from the group which consists of lithium bisulfite, sodium bisulfite and potassium bisulfite, with an aliphatic monoaldehyde having an alkyl or alkenyl group of 1 to 10 carbon atoms, an aliphatic dialdehyde having an alkyl or alkenyl chain of 2 to 10 carbon atoms, an aliphatic monoketone having alkyl or alkenyl chains of 1 to 10 carbon atoms each connected to the ketocarbon, an aliphatic diketone having 1 to 10 carbon atoms in each alkyl or alkenyl group, or an aromatic aldehyde in which the aromatic group is phenyl;

treating said textile fibers with said bath at substantially ambient temperature for a period sufficient to effect whitening of said textile fibers; and thereafter washing and drying said textile fibers.

9. The process defined in claim 8 wherein said bisulfitic derivative is present in an amount between 1 and 30 g/l in said bath.

10. The process defined in claim 9 wherein said bath further comprises an effective amount of neutral sodium sulfite up to an amount of 20 g/l.

11. The process defined in claim 10 wherein, after said textile fibers are impregnated with said bath, impregnating liquid is drained from said textile fibers and said textile fibers are stored in a plastic bag for a period of the order of hours.

12. The process defined in claim 9 wherein said bath has a pH below 5.5.

13. The process defined in claim 9 wherein said organic compound is selected from the group which consists of formaldehyde, acetaldehyde, glycolicaldehyde, glyoxal, acetone, acetylketone, benzaldehyde and cinnamaldehyde.

* * * * *